US009161631B2

(12) United States Patent
Ellington

(10) Patent No.: US 9,161,631 B2
(45) Date of Patent: Oct. 20, 2015

(54) ADJUSTMENT MECHANISM FOR FURNITURE

(71) Applicant: ANTHRO INTERNATIONAL INCORPORATED, Fullerton, CA (US)

(72) Inventor: Derek Ellington, Fullerton, CA (US)

(73) Assignee: ANTHRO INTERNATIONAL INCORPORATED, Fullerton, CA (US)

( * ) Notice: Subject to any disclaimer, the term of this patent is extended or adjusted under 35 U.S.C. 154(b) by 0 days.

(21) Appl. No.: 14/313,849

(22) Filed: Jun. 24, 2014

(65) Prior Publication Data

US 2015/0001902 A1 Jan. 1, 2015

Related U.S. Application Data

(60) Provisional application No. 61/841,794, filed on Jul. 1, 2013.

(51) Int. Cl.

| | |
|---|---|
| ***A47C 7/40*** | (2006.01) |
| ***A47C 1/027*** | (2006.01) |
| ***A47C 1/03*** | (2006.01) |
| ***A47C 1/023*** | (2006.01) |
| ***A47C 3/28*** | (2006.01) |
| *A47C 7/00* | (2006.01) |

(52) U.S. Cl.

CPC ..... *A47C 7/402* (2013.01); *A47C 1/023* (2013.01); *A47C 1/027* (2013.01); *A47C 1/03* (2013.01); *A47C 3/28* (2013.01); *A47C 7/006* (2013.01)

(58) Field of Classification Search

CPC ..... A47C 1/03; A47C 1/027; A47C 1/026; A47C 7/402; A47C 7/462; A47C 3/28; Y10T 403/599; B60N 2002/2204; B60N 2/22; B60N 2/66; B62D 1/02

USPC ..... 297/353, 375

See application file for complete search history.

(56) References Cited

U.S. PATENT DOCUMENTS

| | | | | |
|---|---|---|---|---|
| 4,036,525 | A * | 7/1977 | Howk | 297/353 |
| 4,384,742 | A * | 5/1983 | Wisniewski | 297/353 |
| 4,639,039 | A * | 1/1987 | Donovan | 297/353 |
| 4,786,108 | A * | 11/1988 | Dauphin | 297/353 |
| 5,324,096 | A * | 6/1994 | Schultz | 297/411.36 |
| 8,303,040 | B2 * | 11/2012 | Lai et al. | 297/410 |
| 2003/0071506 | A1 * | 4/2003 | Burgin | 297/353 |
| 2006/0131944 | A1 * | 6/2006 | Helmond et al. | 297/353 |
| 2006/0232115 | A1 * | 10/2006 | Chi | 297/301.1 |
| 2008/0093905 | A1 * | 4/2008 | Maier et al. | 297/353 |
| 2013/0020849 | A1 * | 1/2013 | Hsuan-Chin | 297/307 |
| 2014/0097658 | A1 * | 4/2014 | Chen et al. | 297/353 |

* cited by examiner

*Primary Examiner* — Joshua J Michener
*Assistant Examiner* — Matthew Gitlin
(74) *Attorney, Agent, or Firm* — Knobbe Martens Olson and Bear LLP

(57) ABSTRACT

An adjustment mechanism for an office chair is disclosed. The adjustment mechanism may be used to adjust a height or position of an adjustable member of the chair. The adjustment mechanism can include an adjusting rod threaded through at least one, and in some arrangements two, adjusting members, the adjusting members each having a straight portion and a curved portion, the curved portion of each adjusting member received within a slot of a spreading member such that movement of the spreading member toward the adjusting rod spreads apart the adjusting members, creating a clamping force on the adjusting rod to set the height or position of the adjustable member of the chair.

18 Claims, 10 Drawing Sheets

ADJUSTMENT MECHANISM FOR FURNITURE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

1. Field of the Invention

This application is directed toward adjustment mechanisms, which can be incorporated in furniture, such as office furniture, and more particularly to a chair back height adjustment mechanism.

2. Description of the Related Art

Many specialized types of seating furniture benefit from adjustability of their parts to conform to the particular size of the individual sitting on the furniture. This may include back height adjustment, seat tilt or forward/back extension adjustment, lumbar adjustment, etc. Chairs of this kind may also include armrests that adjust in height relative to the chair body.

In some configurations, components of adjustable office chairs are adjusted with a rotatable knob which controls a frictional clamping relationship. One hand may be used to adjust the height of adjustable member and the other hand may be used to rotate the knob to clamp the adjustable member at a desired height. However, this mechanism requires the user to first rotate the knob to release the clamping force and then rotate the knob again to re-engage the clamping force. This requires a significant amount of hand strength and, thus, may be difficult for some users to perform.

Other chair adjustment mechanisms include a lever-based system in which teeth of the adjustment mechanism engage slots or notches. Typically, such mechanisms allow adjustment only in discrete, predetermined intervals. Furthermore, adjustment of a chair back in a reverse direction (such as down) may only be done after pulling the chair back fully in one direction (such as up), to release the mechanism and allow the adjustment mechanism to reset.

These types of adjusting mechanisms are common due to being uncomplicated and inexpensive to produce. However, these designs have substantial disadvantages in that they are not infinitely adjustable and/or are not easy to adjust with one hand. Additionally, a set-screw-type connection may require substantial force to insure that the part to be adjusted does not slip from its desired position. This may cause user discomfort and may be difficult for some users to operate.

SUMMARY OF THE INVENTION

The present application is directed toward adjustment mechanisms, such as adjustment mechanisms for furniture or similar items. Embodiments of the adjustment mechanisms are particularly illustrated in the context of a chair adjustment mechanism. The term "chair," as used herein, is a broad term and is used in accordance with its ordinary meaning to include office chairs, desk chairs, dining chairs, or any adjustable chair. It is an object of the application to provide adjustment mechanisms that are infinitely adjustable and easy to use.

To achieve some or all of these objects, an embodiment of an adjustable office chair includes an adjusting rod secured to a first portion of the chair and an adjustment mechanism secured to a second portion of the chair that is movable relative to the first portion. The adjustment mechanism includes a first adjusting member having a first straight portion and a first curved portion opposite the first straight portion, the first adjusting member having a throughbore through which the adjusting rod extends, a second adjusting member adjacent to the first adjusting member such that the second adjusting member mirrors the first adjusting member, the second adjusting member having a second straight portion and a second curved portion opposite the second straight portion, the second adjusting member having a throughbore through which the adjusting rod extends, a securing member having a slot that receives the first straight portion of the first adjusting member and the second straight portion of the second adjusting member, a spreading member having a first slot and a second slot, the first slot receives the first curved portion of the first adjusting member, the second slot receives the second curved portion of the second adjusting member, the first slot and the second slot defining a wedge of the spreading member therebetween, and a force component.

The force component acts on the spreading member to push the wedge between the first curved portion and the second curved portion to separate the first adjusting member from the second adjusting member and clamp the first adjusting member and the second adjusting member to the adjusting rod.

Another embodiment of an office chair includes a chair body including a seat, a seat post, and a plurality of legs, an adjustable chair member configured to adjust relative to the chair body, and an adjustment assembly further including a housing having a rear surface, a front surface, a top surface and a bottom surface connected by two side surfaces. The rear surface is connected to the adjustable chair member and to the chair body. The housing includes an adjusting rod defining a longitudinal axis, the adjusting rod secured to the housing by throughbores in the top and bottom surfaces of the housing. The office chair also includes an adjustment mechanism. The adjustment mechanism includes a frame configured with throughbores through a top frame surface and a bottom frame surface such that the frame can slide along the adjusting rod, a securing member secured to a rear surface of the frame, a first adjusting member and a second adjusting member, a spreading member, and a force component perpendicular to the longitudinal axis defined by the adjusting rod. The spreading member and the force component are configured within the frame to allow movement of the spreading member relative to frame. The first adjusting member and the second adjusting member each include a straight portion and a curved portion, each of the first adjusting member and the second adjusting member having a throughbore through which the adjusting rod extends. The securing member includes a slot that receives the straight portion of each of the first adjusting member and the second adjusting member. The spreading member includes a first slot and a second slot configured such that a wedge is formed between the first slot and the second slot. The wedge is configured to spread apart the first adjusting member and the second adjusting member. The first slot and the second slot receive the curved portion of each of the first adjusting member and the second adjusting member.

Yet another embodiment of a piece of adjustable furniture includes a first furniture portion including an adjusting rod defining a longitudinal axis and a second furniture portion that is adjustable relative to the first furniture portion. The second furniture portion includes an adjustment mechanism. The adjustment mechanism includes at least one adjusting member having a throughbore through which the adjusting rod extends, the at least one adjusting member movable between a locked position and an unlocked position, wherein, in the locked position, relative movement between the adjusting rod and the at least one adjusting member is prevented and, in the unlocked position, relative movement between the adjusting rod and the at least one adjusting member is permitted; an actuating member that moves the at least one adjusting member from the unlocked position to the locked position; anda force component. The force component acts on the actuating member to urge the actuating member in a direction that moves the at least one adjusting member toward the locked position.

BRIEF DESCRIPTION OF THE DRAWINGS

These and other features, aspects and advantages of the various devices, systems and methods presented herein are described with reference to drawings of certain embodiments, which are intended to illustrate, but not to limit, such devices, systems, and methods. It is to be understood that the attached drawings are for the purpose of illustrating concepts of the embodiments discussed herein and may not be to scale.

DETAILED DESCRIPTION OF THE PREFERRED EMBODIMENTS

Embodiments of an adjustable mechanism are disclosed herein. The embodiments disclosed herein often are described in the context of an adjustable mechanism for use with an office chair. In some aspects, an adjustment mechanism could comprise a rod threaded through at least one or, in some arrangements, two retention elements or arms, which are embodied as J-shaped members in the illustrated configurations. Thus, references to "J-shaped members" herein are used for convenience and may also refer to other retention elements unless otherwise indicated. Separation of the J-shaped members apart from each other, or tilting movement of the J-shaped members relative to the rod, increases the friction of each member on the rod, allowing a seat back height or forward/aft movement of a seat to be infinitely adjustable along the length of the rod.

Figure 1:
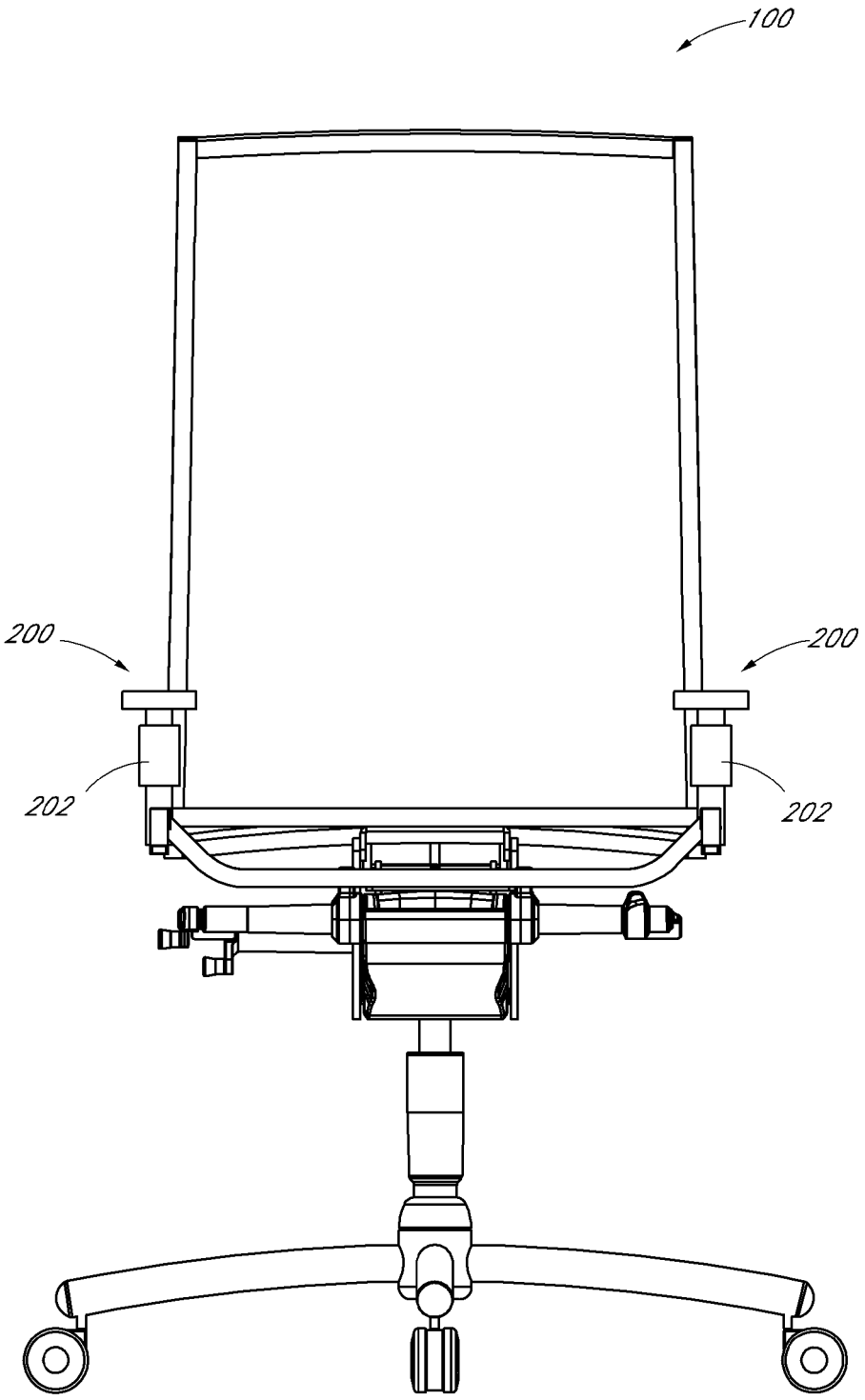
FIG. 1 illustrates a front view of an office chair having a back seat height adjustment, armrest height adjustment, and seat height adjustment assembly and mechanism according to some aspects of the invention.

FIG. 1 illustrates an office chair 100 configured with an adjustment assembly configured to adjust the back height of the chair. The office chair 100 may also have an adjustment assembly 202 to adjust the height of an armrest 200. The adjustment assembly discussed below may also be used to adjust a relative position of any two portions of the chair, such as the height of the armrests of the chair, the fore or aft position of the seat, or the height of the seat. Similarly, the disclosed embodiments may be used to allow adjustment of a relative position of any two portions of other types of furniture or similar objects or items, such as height adjustment of a desk (i.e., movement of desk top relative to base or legs to adjust the height of the work surface).

Figure 2:
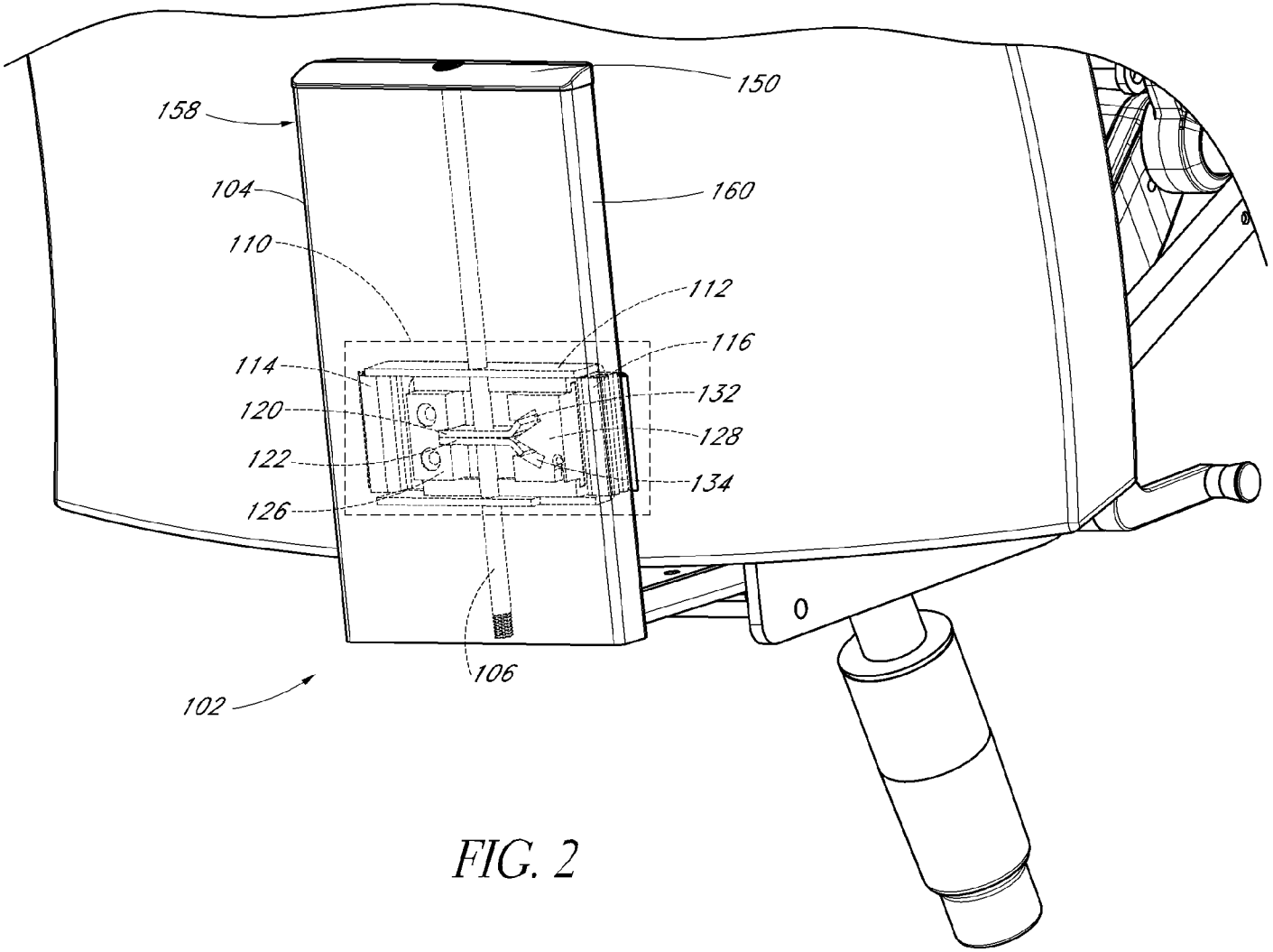
FIG. 2 illustrates a rear perspective view of an office chair having a back seat height adjustment assembly and mechanism according to some aspects of the invention.
Figure 3:
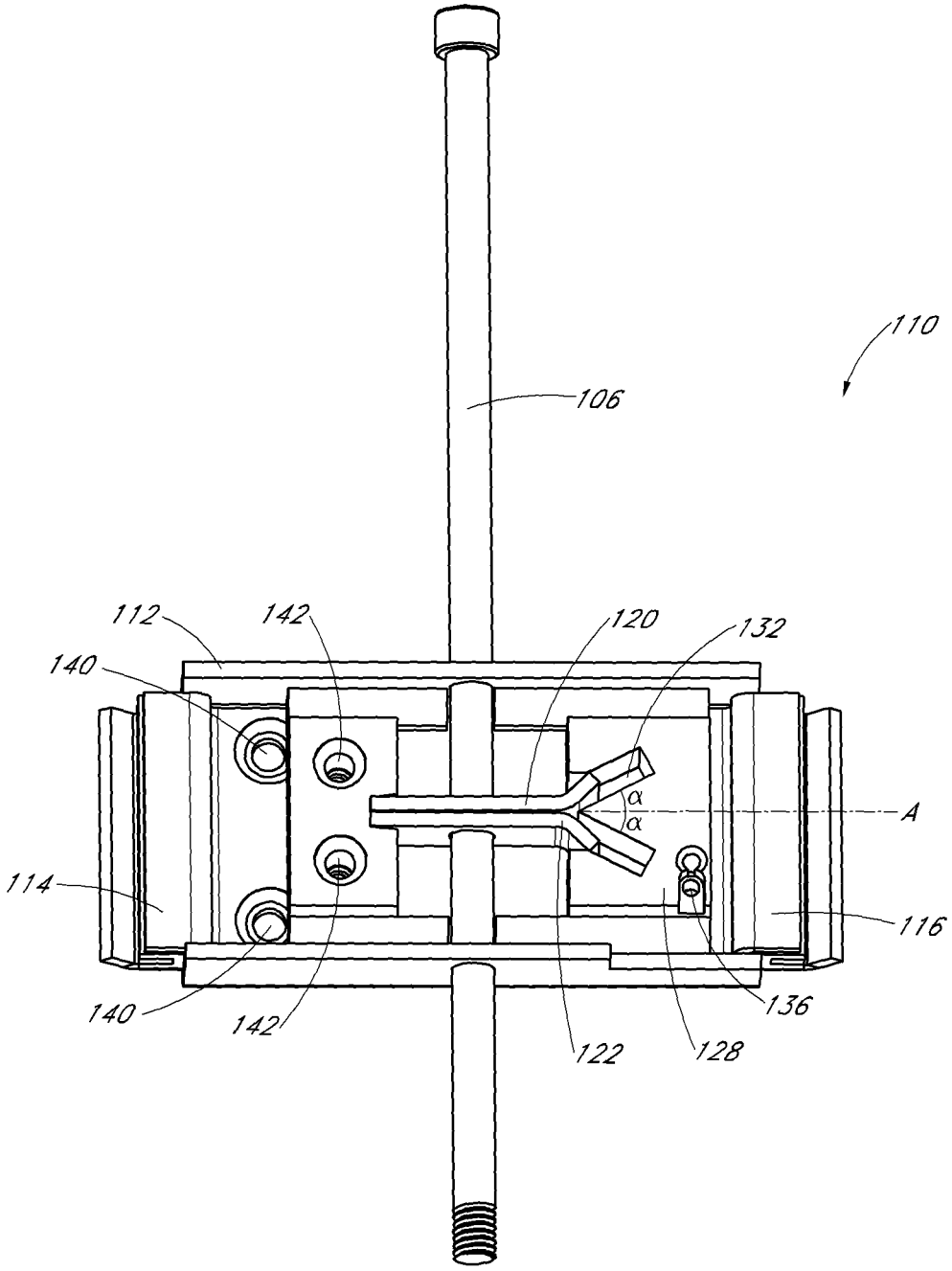
FIG. 3 illustrates an adjustment mechanism according to some aspects of the invention.

FIG. 2 illustrates one embodiment of an adjustment assembly 102 configured to adjust the back height of an office chair. With reference to FIGS. 2 and 3, an adjustment assembly 102 can include an adjustment assembly housing 104 containing an adjustment mechanism 110. The adjustment assembly housing 104 may have any one or more of a front surface 154, a rear surface 156, a top surface 150, a bottom surface 152, and two side surfaces 158, 160 and may be made of any rigid material, such as metal or plastic. In some embodiments, the rear surface 156 of the adjustment assembly housing 104 may be attached to one portion (e.g., a seat back) of an adjustable chair to allow the adjustable seat back to move relative to the chair frame. In other embodiments, the adjustment assembly housing 104 may be attached to any adjustable member of a chair or furnishing on one end and to a rigid frame member of the chair or other furnishing on the other end such that the adjustment mechanism can provide adjustment of the adjustable member relative to the rigid frame member.

The adjustment mechanism 110 can comprise an adjusting rod 106, a frame 112, one or more adjusting members 120, 122, a securing member 126 and a spreading member 128. The threaded adjusting rod may have a bolt head that abuts the top surface 150 of the adjustment assembly housing 104. The frame 112 is capable of sliding vertically along the adjusting rod 106. Within the frame 112 may be two sliding members 114 and 116 that align the frame 112 within the adjustment assembly housing 104 to prevent rotation of the frame 112 around the adjusting rod 106. The sliding members 114, 116 may be aligned with ridges, grooves, or rails longitudinally placed on the inner surfaces of the side surfaces 158, 160 of the adjustment assembly housing 104 to guide the frame 112 as it slides within the adjustment assembly housing 104. Other guide arrangements could be used, such as a set of rods aligned on either side of the adjustment assembly housing 104 or another type of anti-rotation device.

With continuing reference to FIGS. 2 and 3, the adjusting rod 106 may be inserted through openings in the top and bottom surface of the frame 112 and through two generally J-shaped adjusting members 120, 122. In some embodiments, the adjusting rod 106 may have a circular or oblong cross-section. In other embodiments, the adjusting rod 106 may have a non-circular cross-section, such as a rectangular cross-section. In some embodiments, the adjusting rod 106 may be a structural support portion of the chair, such as a J-bar member. In this embodiment, the adjusting members 120, 122 may be configured with slots instead of holes such that the adjusting members 120, 122 slot onto the J-bar member. A securing member 126 may be secured to the frame 112 using fasteners 142.

The J-shaped adjusting members 120, 122 may be substantially rectangular shaped members with one end curved or angled to form a "J" shape. The J-shaped adjusting members 120, 122 may be formed from metal, plastic, or another rigid material. In some embodiments, the adjusting members 120, 122 are located adjacent to each other such that one adjusting member 120 is a mirror image of the second adjusting member 122. In other words, the adjusting members 120, 122 are aligned such that the straight portions of each adjusting member 120, 122 are adjacent and the curved portions of each adjusting member 120, 122 are adjacent. The curved portions of each adjusting member 120, 122 preferably face in substantially opposite directions such that a wedge-shaped opening is formed between the curved portions. One end of the J-shaped adjusting members 120, 122, preferably the straight portions, may be secured within a notch in the securing member 126 or by any other arrangement that permits pivoting of the J-shaped adjusting members 120, 122. A spreading member 128 may be slidably secured to the frame 112 such that it may slide horizontally within the frame 112. The spreading member 128 may include one or more slots 132, 134. The slots 132, 134 can receive the opposite, or angled, ends of the adjusting members 120, 122. The slots 132, 134 of the spreading member 128 may be angled such that a generally triangular wedge 130 is formed between them. In some embodiments, a triangular wedge 130 may be formed without the slots 132, 134; however, slots 132, 134 are a preferred configuration to capture and better control the movement of the J-shaped adjusting members 120, 122.

In a neutral, or adjustable, position such as that shown in FIG. 2, the adjusting mechanism 110 and frame 112 can slide with little or no resistance vertically along the adjusting rod 106. In this configuration, the adjusting members 120, 122 are aligned substantially orthogonal to the vertical axis defined by the adjusting rod 106. The wedge 130 of the spreading member 128 can be used to push apart the adjusting members 120, 122, decreasing the angle that each adjusting member 120, 122 makes with a vertical or longitudinal axis defined by the adjusting rod 106. As will be described in further detail below, separation of the adjusting members 120, 122 increases the friction or retention force between the adjusting members 120, 122 and the adjusting rod 106 to allow the adjusting members 120, 122 to exert a clamping force on the adjusting rod 106. Due to the lack of notches or other discrete adjustment intervals, infinite adjustment of the adjustment mechanism 110 along the adjusting rod 106 may be possible with this arrangement. The spreading member 128 can be spring-loaded such that a spring force pushes the spreading member 128 towards the adjusting members 120, 122, spreading them apart and securing the adjustment mechanism 110 in a fixed position on the rod 106.

With continued reference to FIGS. 2 and 3, the curved ends of the adjusting members 120, 122 can slide within the slots 132, 134 to facilitate the separation of the adjusting members 120, 122. The slots 132, 134 may be arranged at an angle a from a horizontal line A orthogonal to the vertical or longitudinal axis defined by the adjusting rod 106. As the spreading member 128 moves toward the adjusting rod, the wedge 130 separates the adjusting members 120, 122, forcing one adjusting member to move generally in one direction and the other adjusting member to move generally in the opposite direction. The increased separation of the adjusting members 120, 122 increases the friction between the adjusting rod 106 and the adjusting members 120, 122 at the point where the adjusting rod 106 passes through each adjusting members 120, 122. The increased friction between the adjusting rod 106 and the adjusting members 120, 122 is due to increased resistance on the adjusting rod 106 due to the angle of the adjusting members 120, 122 with respect to the longitudinal axis defined by the adjusting rod 106. As the separation distance between the angled ends of the adjusting members 120, 122 increases, the ability of the adjusting rod 106 to pass smoothly through the holes in the adjusting members 120, 122 will decrease. As the adjusting members 120, 122 depart from an orthogonal orientation with the adjusting rod 106 (that is, the angle between the adjusting members 120, 122 increases) the adjusting members 120, 122 will act as a clamp on the adjusting rod 106, limiting further movement of the adjustment mechanism 110 along the adjusting rod 106.

Figure 4:
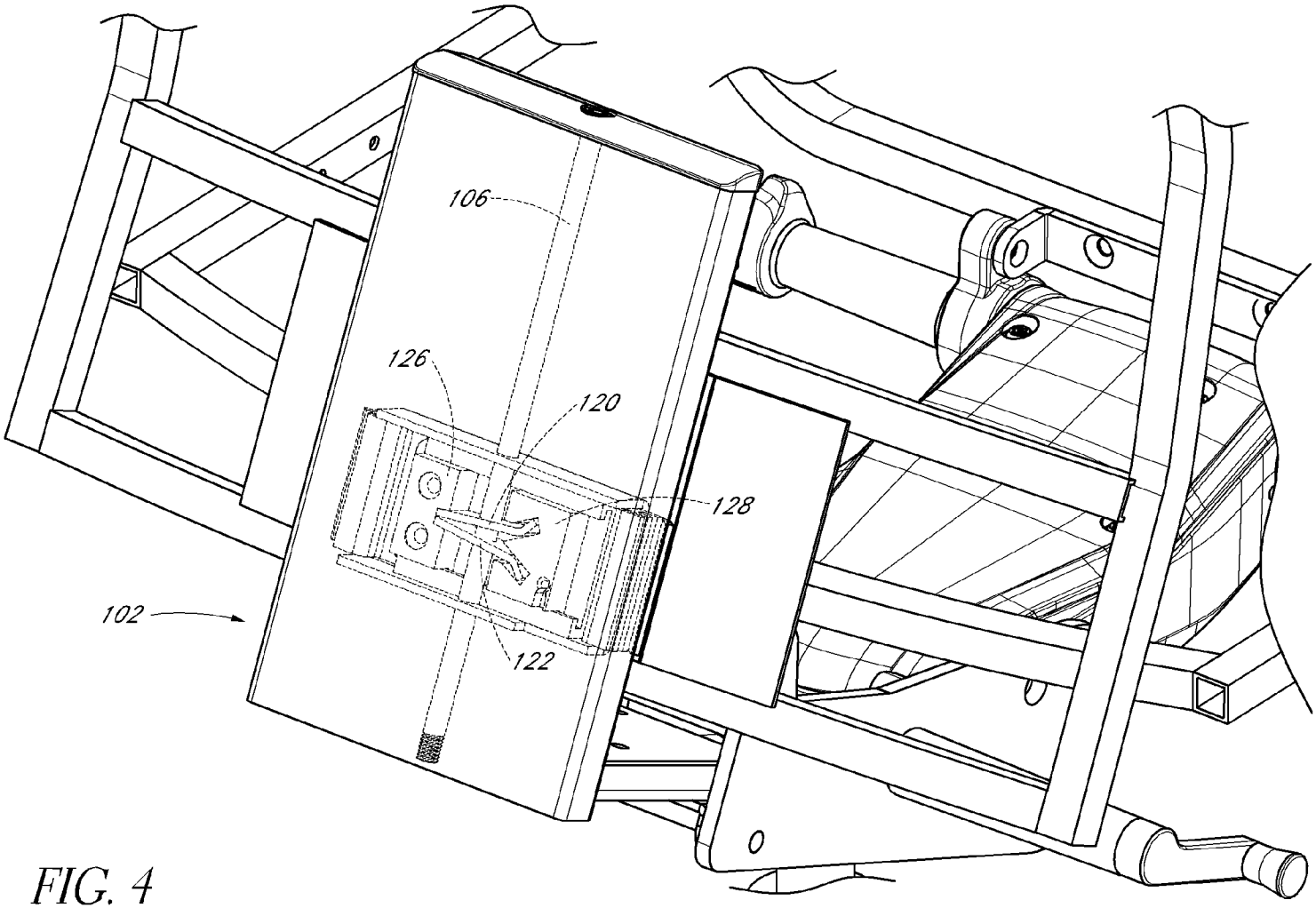
FIG. 4 illustrates a rear perspective close up view of an adjustment assembly and mechanism for a chair back height adjustment in a gripping configuration, according to some aspects of the invention.
Figure 5:
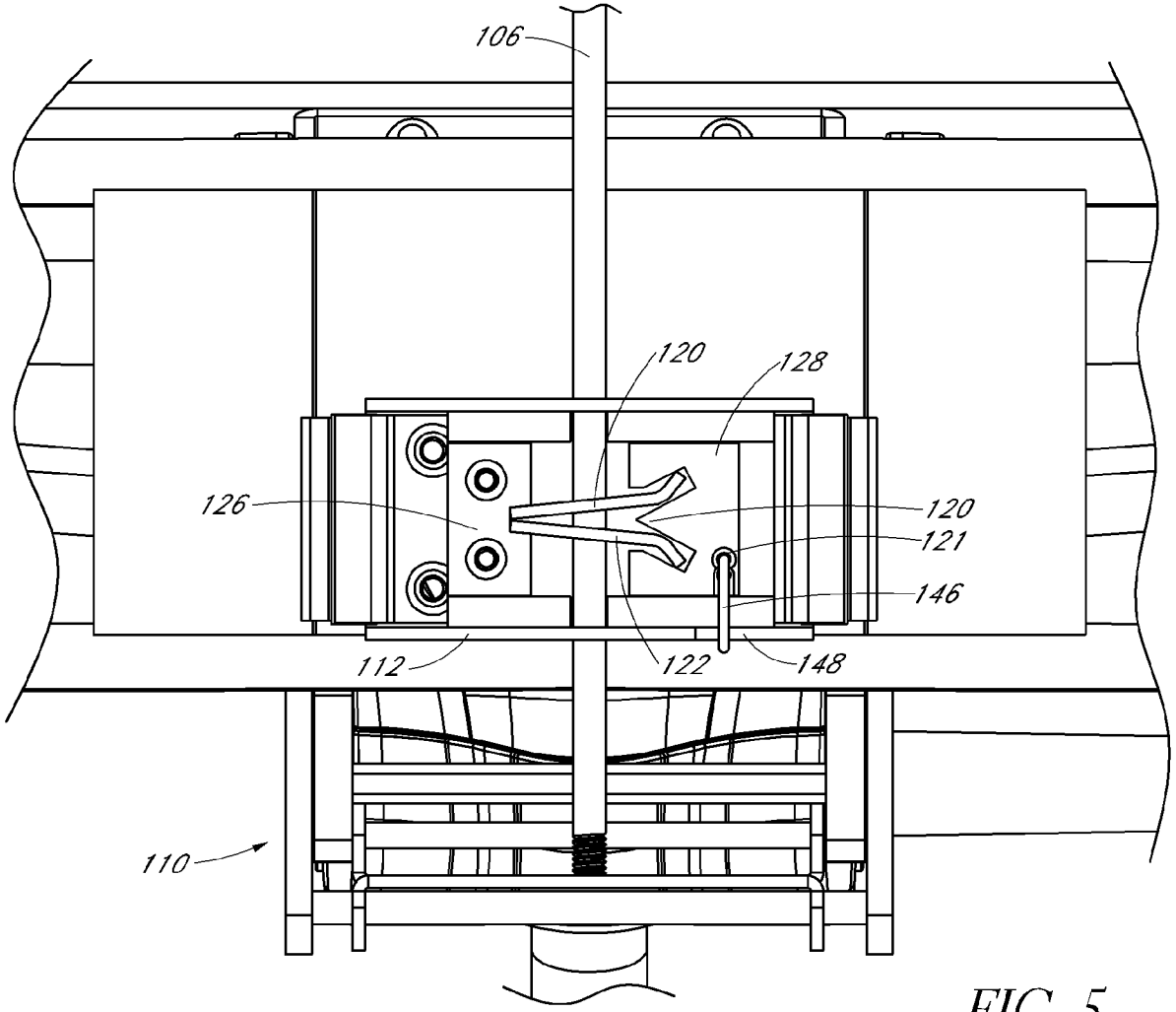
FIG. 5 illustrates a second view of a rear view of an adjustment assembly and mechanism for a chair back height adjustment in a gripping configuration.
Figure 6:
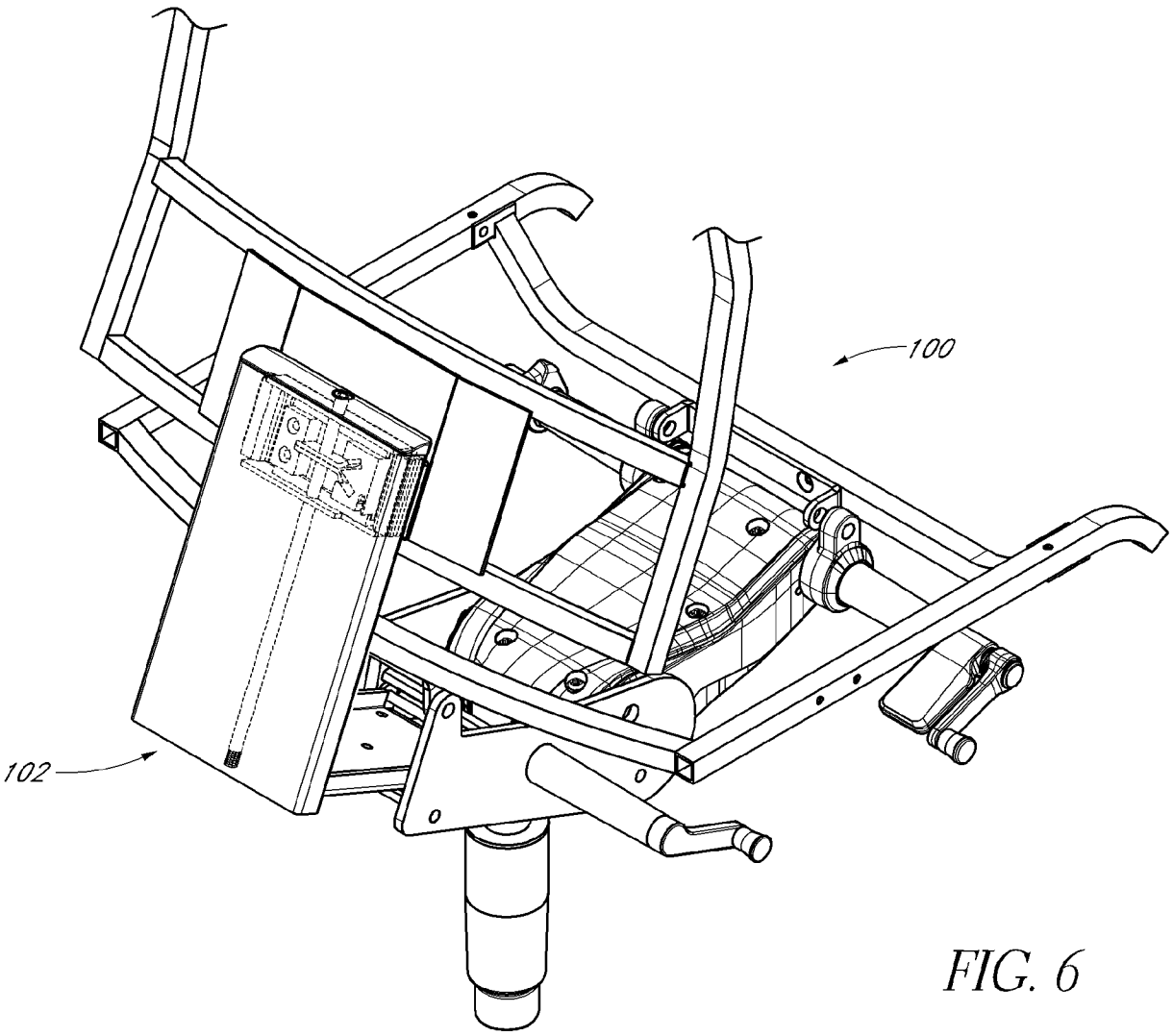
FIG. 6 illustrates a rear perspective close up view of an adjustment assembly and mechanism for a chair back height adjustment in a released configuration, according to some aspects of the invention.
Figure 7:
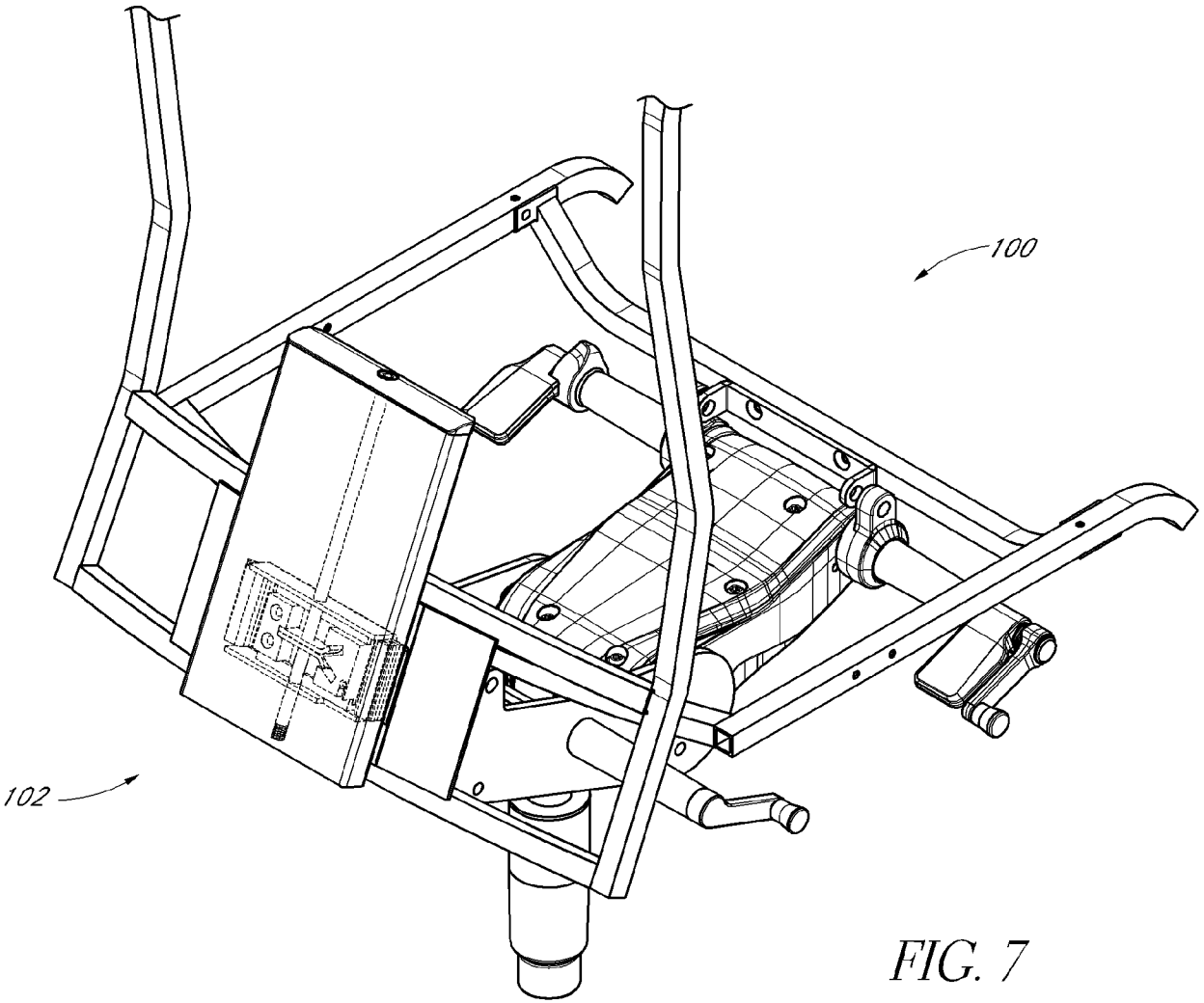
FIG. 7 illustrates a view of an adjustment assembly and mechanism for a chair back height adjustment in a release configuration with the chair back at a low height adjustment.
Figure 8:
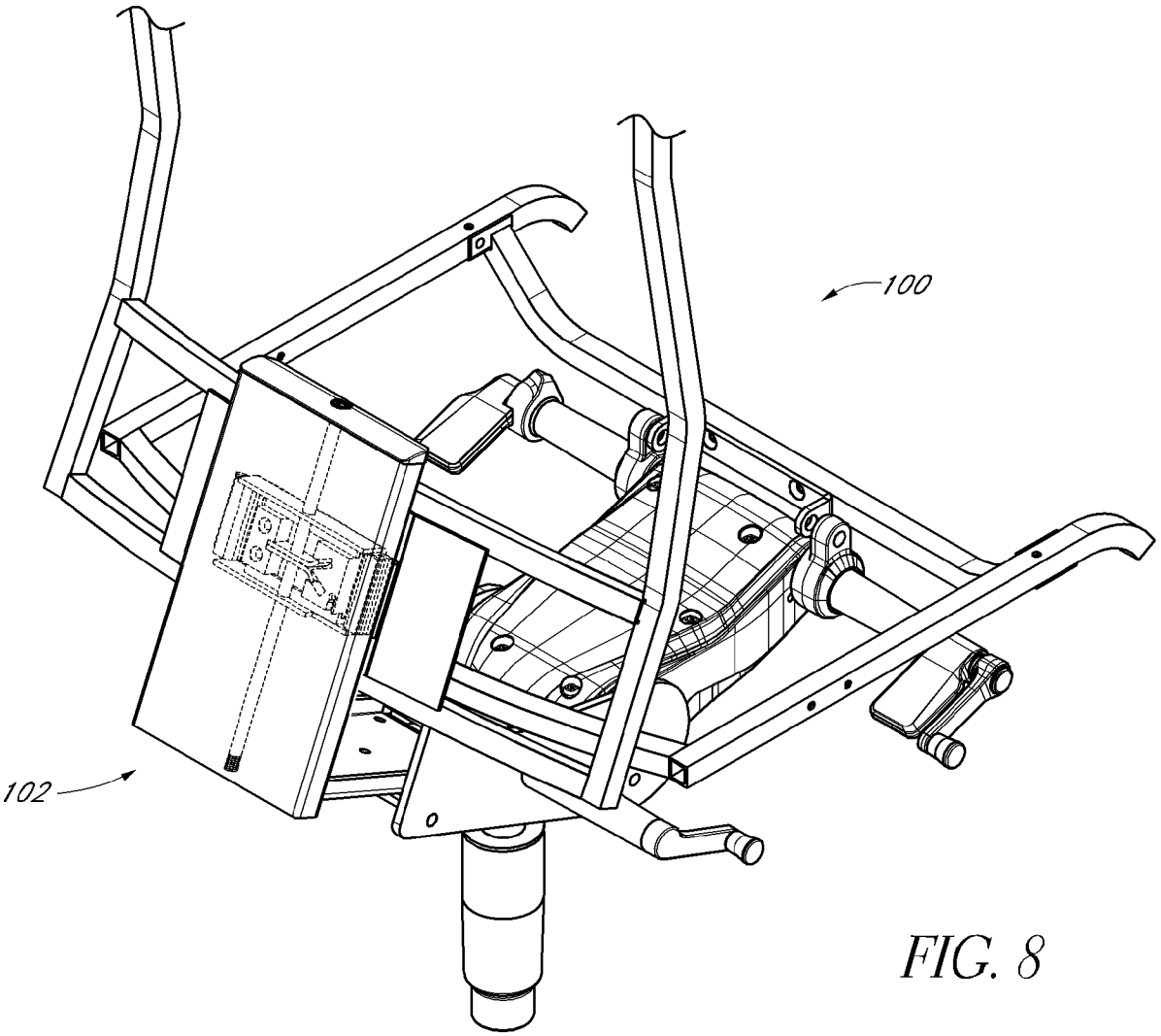
FIG. 8 illustrates a view of an adjustment assembly and mechanism for a chair back height adjustment in a release configuration with the chair back at a mid-height adjustment.
Figure 9:
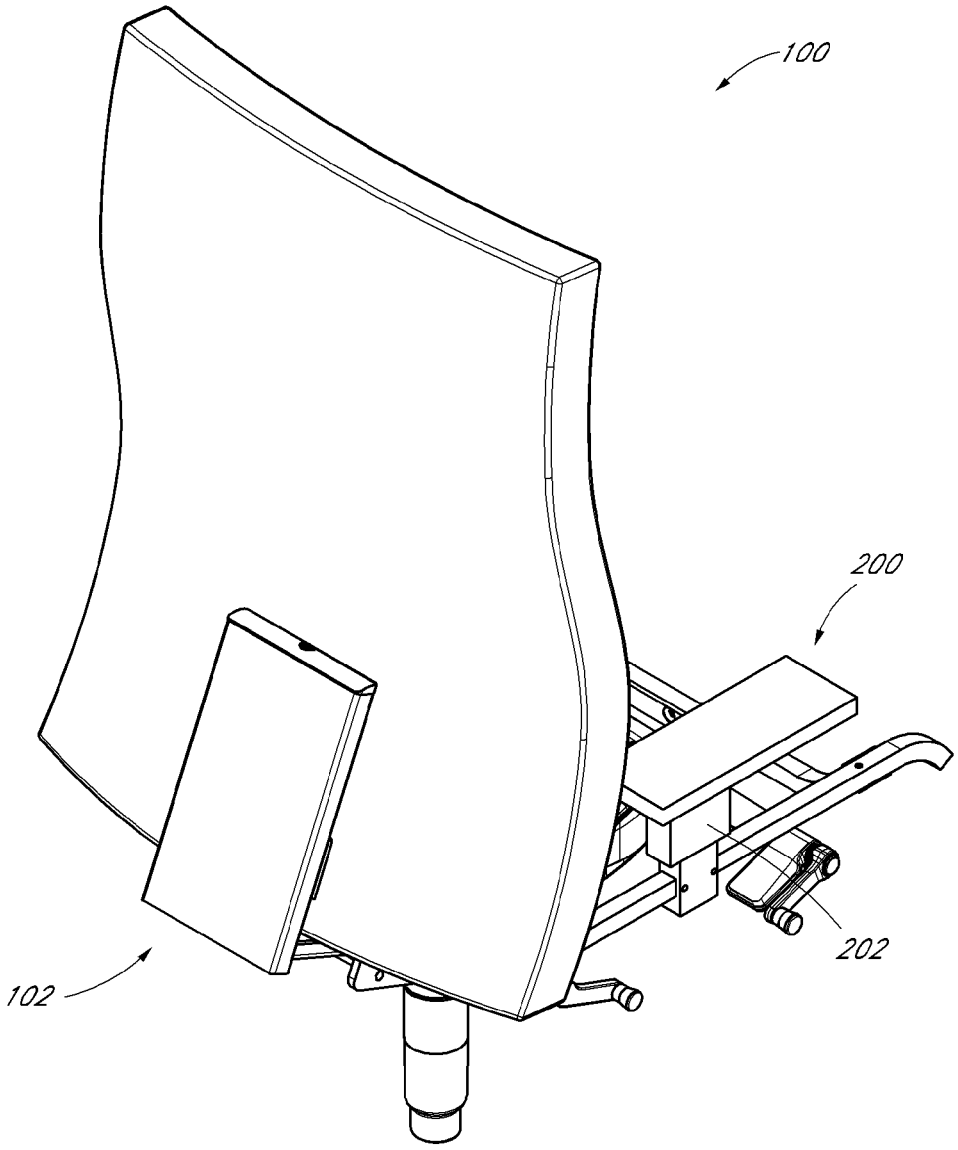
FIG. 9 illustrates a rear perspective view of an office chair incorporating an adjustment assembly and mechanism according to some aspects of the invention.

One embodiment of an adjustment mechanism 110 in a gripping configuration for a back seat height adjustment for an office chair is shown in FIGS. 4 and 5. As discussed above, in this configuration the wedge 130 of the spreading member 128 has spread apart the adjusting members 120, 122, increasing the separation distance between them. The increased separation distance between the adjusting members 120, 122 limits the movement of the adjustment mechanism 110 along the adjusting rod 106. The spreading member 128 may be acted on by a force component to force apart the adjusting members 120, 122 and clamp the adjustment mechanism 110 in place at any point along the adjusting rod 106. The force component may be a spring or other force exerting element. In some embodiments, the spreading member 128 may be biased to a locking or gripping position of the adjustment mechanism. Therefore, the height of the seat back of an office chair, as shown in FIG. 4, may be set at any point along the adjusting rod 106 by pushing the spreading member 128 away from the adjusting rod 106 to release the clamping force, raising or lowering the seat back height to the desired level, and then releasing the spreading member 128, allowing it to force apart the adjusting members 120, 122 and apply a clamping force on the adjusting rod 106 at the desired height. Any suitable mechanism can be used to move the spreading member 128 away from the adjusting rod 106 to release the clamping force. In a preferred embodiment, this mechanism is external to the adjustment assembly housing 104 so that adjustment may be easily accessible. The spreading member 128 may be separated from the adjusting rod 106 using either pulling or pushing force.

As shown in FIG. 5, the adjustment mechanism may be locked in a gripping position by locking member 146. Locking member 146 may be a pin inserted within an opening 136 in the spreading member 128. When the adjustment mechanism is in a gripping position, the locking member 146 may fit within a groove 148 in the frame 112 to prevent further movement of the spreading member.

FIGS. 6-10 illustrate an office chair configured with an adjustable seat back height adjustment assembly 102 according to one embodiment. The adjustment mechanism 110 as shown in these figures is in the released configuration such that the adjusting members 120, 122 are not applying a clamping force on the adjusting rod 106. As illustrated, the adjustment mechanism 110 may be raised or lowered along the adjusting rod 106 within the adjustment assembly housing 104 to adjust the seat back height to any position along the adjusting rod 106.

Although a preferred embodiment of the adjustment mechanism 110 includes a pair of adjusting members 120, 122, an alternative configuration can utilize a single one of the adjusting members 120, 122 and the other adjusting member 120, 122 can be omitted. Such an arrangement would permit adjustment as described above in one direction and would permit essentially unrestricted movement in the other direction. Such an arrangement would provide operation similar to other chair adjustment mechanisms presently marketed. In particular, in one configuration, the chair back could be moved upwardly essentially without restriction because the movement of the rod 106 would tend to move the adjusting member 122 toward an orthogonal position. However, the adjustment assembly 102 would inhibit downward movement of the chair back unless purposely released.

Figure 10:
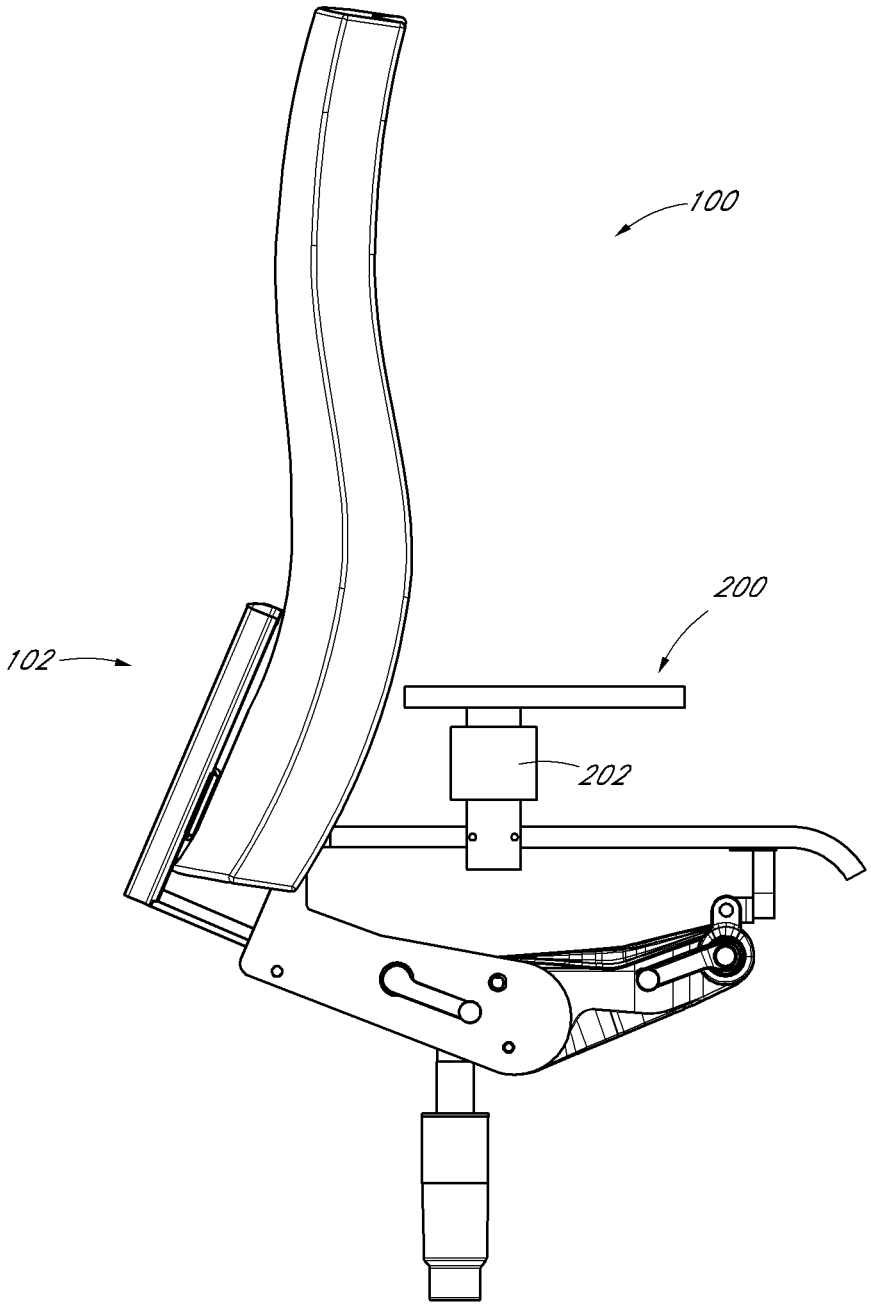
FIG. 10 illustrates a side view of an office chair incorporating an adjustment assembly and mechanism.

As shown in FIG. 10, the adjustment assembly housing 104 may be attached to the seat back of an office chair in order to raise and lower the seat back height. In other embodiments, an adjustment mechanism 202 may be used to raise and lower the height of one or more armrests 200, to raise or lower the chair seat, or to move the chair seat forward and aft. In each embodiment, the adjustment mechanism provides for infinite adjustment along the adjusting rod or within the available range of adjustment.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments can be made and still fall within the scope of the invention. It should be understood that various features and aspects of the disclosed embodiments can be combined with or substituted for one another in order to form varying modes of the disclosed invention. Thus, it is intended that the scope of at least some of the present invention herein disclosed should not be limited by the particular disclosed embodiments described above.

What is claimed is:

1. An adjustable office chair, comprising:

an adjusting rod secured to a first portion of the chair;

an adjustment mechanism secured to a second portion of the chair that is movable relative to the first portion, the adjustment mechanism comprising:

a first adjusting member having a first straight portion and a first curved portion opposite the first straight portion, the first adjusting member having a throughbore through which the adjusting rod extends;

a second adjusting member adjacent to the first adjusting member such that the second adjusting member mirrors the first adjusting member, the second adjusting member having a second straight portion and a second curved portion opposite the second straight portion, the second adjusting member having a throughbore through which the adjusting rod extends;

a securing member having a slot that receives the first straight portion of the first adjusting member and the second straight portion of the second adjusting member;

a spreading member having a first slot and a second slot, the first slot receives the first curved portion of the first adjusting member, the second slot receives the second curved portion of the second adjusting member, the first slot and the second slot defining a wedge of the spreading member therebetween; and a force component;

wherein the force component acts on the spreading member to push the wedge between the first curved portion and the second curved portion to separate the first adjusting member from the second adjusting member and clamp the first adjusting member and the second adjusting member to the adjusting rod.

2. The adjustable office chair of claim 1, wherein the adjusting rod has a circular cross-section.

3. The adjustable office chair of claim 1, wherein the force component comprises a spring element.

4. The adjustable office chair of claim 1, further comprising a locking member configured to lock the adjustment mechanism in a gripping configuration.

5. The adjustable office chair of claim 1, wherein the first portion of the chair comprises a housing having a rear surface, a front surface, a top surface and a bottom surface connected by two side surfaces, the housing comprising the adjusting rod and the adjustment mechanism, the adjusting rod secured to the housing by throughbores in the top and bottom surfaces of the housing.

6. The adjustable office chair of claim 1, wherein the second portion of the chair comprises a frame.

7. The adjustment mechanism of claim 1, further comprising anti-rotational members secured to the first portion of the chair to prevent rotation of the adjustment mechanism about the adjusting rod.

8. The adjustment mechanism of claim 7, wherein the anti-rotational members comprise one of rails and grooves.

9. An office chair, comprising:

a chair body comprising a seat, a seat post, and a plurality of legs;

an adjustable chair member configured to adjust relative to the chair body;

an adjustment assembly further comprising a housing having a rear surface, a front surface, a top surface and a bottom surface connected by two side surfaces, the rear surface connected to the adjustable chair member and to the chair body, the housing comprising an adjusting rod defining a longitudinal axis, the adjusting rod secured to the housing by throughbores in the top and bottom surfaces of the housing and an adjustment mechanism, the adjustment mechanism comprising a frame configured with throughbores through a top frame surface and a bottom frame surface such that the frame can slide along the adjusting rod, a securing member secured to a rear surface of the frame, a first adjusting member and a second adjusting member, a spreading member, and a force component perpendicular to the longitudinal axis defined by the adjusting rod, the spreading member and the force component configured within the frame to allow movement of the spreading member relative to frame, the first adjusting member and the second adjusting member each comprising a straight portion and a curved portion, each of the first adjusting member and the second adjusting member having a throughbore through which the adjusting rod extends, the securing member comprising a slot that receives the straight portion of each of the first adjusting member and the second adjusting member, the spreading member comprising a first slot and a second slot configured such that a wedge is formed between the first slot and the second slot, the wedge configured to spread apart the first adjusting member and the second adjusting member, wherein the first slot and the second slot receive the curved portion of each of the first adjusting member and the second adjusting member.

10. The office chair as in claim 9, wherein the adjustable chair member is one of a backrest, an arm rest, or both.

11. A piece of adjustable furniture, comprising:

a first furniture portion comprising an adjusting rod defining a longitudinal axis; and a second furniture portion that is adjustable relative to the first furniture portion, the second furniture portion comprising an adjustment mechanism, the adjustment mechanism comprising:

at least one adjusting member having a throughbore through which the adjusting rod extends, the at least one adjusting member movable between a locked position and an unlocked position, wherein, in the locked position, relative movement between the adjusting rod and the at least one adjusting member is prevented and, in the unlocked position, relative movement between the adjusting rod and the at least one adjusting member is permitted;

an actuating member that moves the at least one adjusting member from the unlocked position to the locked position; and a force component;

wherein the force component acts on the actuating member to urge the actuating member in a direction that moves the at least one adjusting member toward the locked position.

12. The adjustable furniture of claim 11, wherein the adjusting rod has a circular cross-section.

13. The adjustable furniture of claim 11, wherein the force component comprises a spring element.

14. The adjustable furniture of claim 11, further comprising a locking member configured to lock the adjustment mechanism in a gripping configuration.

15. The adjustable furniture of claim 11, wherein the first furniture portion further comprises a housing having a rear surface, a front surface, a top surface and a bottom surface connected by two side surfaces, wherein the adjusting rod is secured to the housing by throughbores in the top and bottom surfaces of the housing.

16. The adjustable furniture of claim 11, wherein the second furniture portion further comprises a frame.

17. The adjustable furniture of claim 11, wherein the first furniture portion further comprises anti-rotational members to prevent rotation of the adjustment mechanism about the adjusting rod.

18. The adjustable furniture of claim 17, wherein the anti-rotational members comprise one of rails and grooves.

* * * * *

UNITED STATES PATENT AND TRADEMARK OFFICE

CERTIFICATE OF CORRECTION

PATENT NO. : 9,161,631 B2
APPLICATION NO. : 14/313849
DATED : October 20, 2015
INVENTOR(S) : Derek Ellington It is certified that error appears in the above-identified patent and that said Letters Patent is hereby corrected as shown below:

IN THE SPECIFICATION

In column 5 at line 55, After "angle" change "a" to --α--.

Signed and Sealed this
Fifth Day of July, 2016

Michelle K. Lee

Michelle K. Lee
*Director of the United States Patent and Trademark Office*